United States Patent [19]

Meyers et al.

[11] 4,043,503

[45] Aug. 23, 1977

[54] RECLOSABLE CARTON

[75] Inventors: George Leroy Meyers, Menasha; David Charles Mueller, Neenah, both of Wis.

[73] Assignee: American Can Company, Greenwich, Conn.

[21] Appl. No.: 705,341

[22] Filed: July 14, 1976

[51] Int. Cl.[2] ..... B65D 5/56; B56D 17/00

[52] U.S. Cl. ..... 206/613; 229/17 R; 206/625; 206/633; 229/17 R

[58] Field of Search ..... 229/51 TS, 51 SC, 51 TC, 229/17 R

[56] References Cited

U.S. PATENT DOCUMENTS

| | | | |
|---|---|---|---|
| 2,828,060 | 3/1958 | Brown | 229/51 SC X |
| 3,346,166 | 10/1967 | Koolnis | 229/17 R |
| 3,399,820 | 9/1968 | Foster et al. | 229/51 TS X |
| 3,521,809 | 7/1970 | Zimmerman | 229/17 R |
| 3,526,353 | 9/1970 | Jaeschke | 229/51 TS |
| 3,580,466 | 5/1971 | Thelen | 229/51 TS X |

FOREIGN PATENT DOCUMENTS

| | | | |
|---|---|---|---|
| 741,190 | 8/1966 | Canada | 229/51 SC |

*Primary Examiner*—Davis T. Moorhead
*Attorney, Agent, or Firm*—Robert P. Auber; Ira S. Dorman; John M. Winter

[57] ABSTRACT

A carton with a reclosable hinged cover formed by laterally spaced cut score lines in its top panel and front glue flap. The cut score lines in the glue flap flare upwardly to form arrow locking tabs which may be pushed through the cover opening so that the shoulders of the tabs lock under the front edge of the top panel. In the preferred form, the cut score lines forming the shoulders of the locking tabs extend only a portion of the way through the thickness of the paperboard and the cut score lines forming the cover portions in the top panel and glue flap are of the inside-outside double cut score type which provides partial thickness locking tabs and an overlapping cover.

6 Claims, 7 Drawing Figures

RECLOSABLE CARTON

BACKGROUND OF THE INVENTION

This invention relates to a reclosable carton and more particularly to a carton with a reclosable hinged cover with locking tabs.

While reclosable cartons of many types including hinged covers formed by double cut scores and with arrow locks insertable into slots in the front panel have been utilized in the packaging of various articles such as food products and the like, none of the type with the particular advantages disclosed herein is known.

SUMMARY OF THE INVENTION

The paperboard blank of this invention forms a carton which is easy to open and reclose, is neat in appearance when reclosed, and has a reliable locking feature which is easy to reopen.

The carton has a reclosable hinged cover formed by laterally spaced cut score lines in its top panel and front glue flap. The score lines in the glue flap flare upwardly and meet the fold line defining the glue flap and top panel outwardly of the score lines in the top panel to form arrow locking tabs at the sides of the cover portion formed in the glue flap.

In the preferred form the cut score lines forming the shoulders of the locking tabs extend only a portion of the way through the thickness of the paperboard so that the formation of the locking tabs do not result in a slit at the top front edge of the carton through which the locking tabs could otherwise accidentally be withdrawn. The cut score lines forming the cover portions in the top panel and front glue of the carton are of the inside-outside double cut score type. This construction provides partial thickness locking tabs of a particularly reliable nature but which are not so stiff as to make the reopening of the cover difficult. It also provides ease of opening, overlapping side edges on the top cover portion, a neat reclosed appearance, and maintains the top cover portion in substantially the same plane as the surrounding top panel when the carton is reclosed.

Further objects, features and advantages of the invention will be apparent from the following detailed description taken in conjuction with the accompanying drawing showing a preferred embodiment of the invention for exemplification.

DESCRIPTION OF PREFERRED EMBODIMENTS

Figure 1:
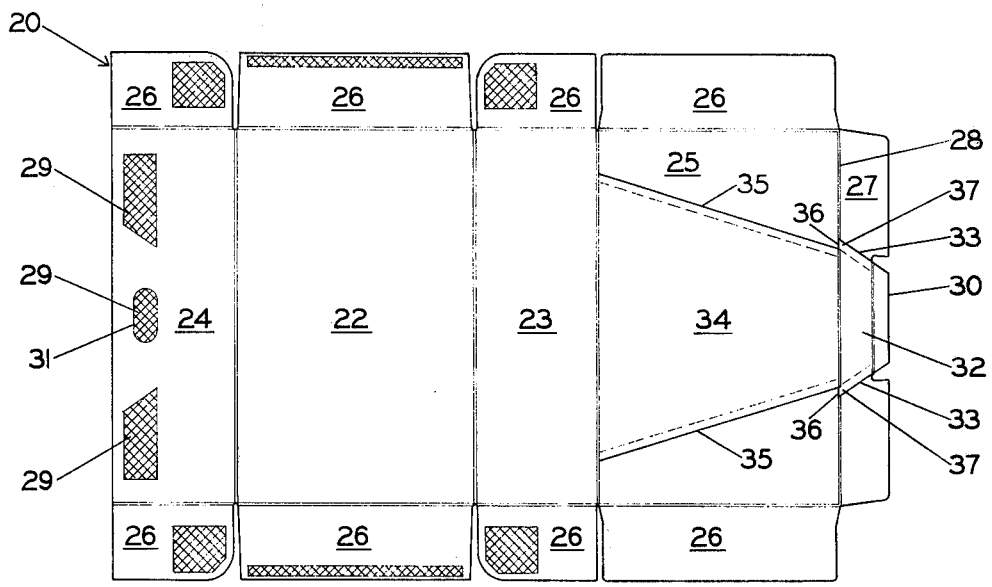
FIG. 1 is a plan view of the outside surface of a carton blank embodying the principles of this invention.
Figure 4:
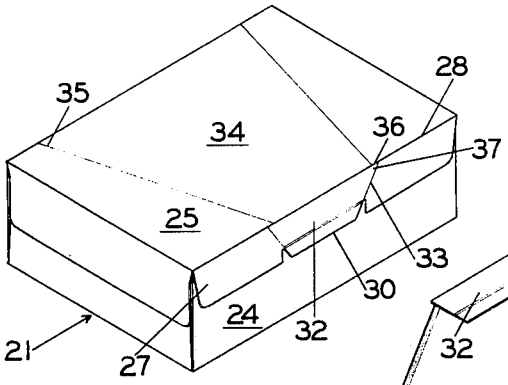
FIG. 4 is an isometric view of a closed carton formed from the blank of FIG. 1.
Figure 5:
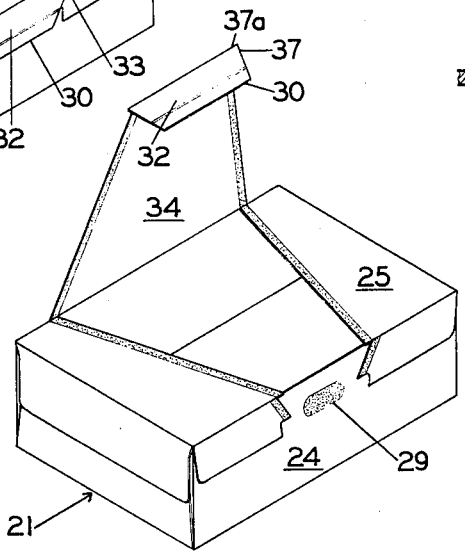
FIG. 5 is an isometric view of the opened carton of FIG. 4.
Figure 6:
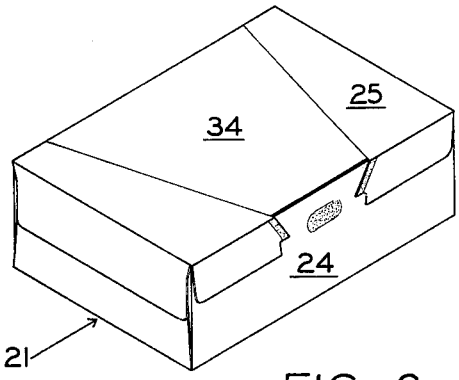
FIG. 6 is an isometric view of the reclosed carton of FIG. 5.

Referring more particularly to the drawings wherein like numerals refer to like parts throughout the several views, the paperboard blank 20, as shown in FIG. 1, is suitably cut and scored to provide a reclosable carton generally referred to at 21 in FIGS. 4-6. The blank 10 has a bottom panel 22, back panel 23, front panel 24, top panel 25, end panels 26 and a front glue flap 27 all hingedly connected in the well known manner.

The front glue flap 27 is connected along fold line 28 to the top panel 25. The front glue flap is adapted to be adhered to the front panel 24 by adhesive applied in the areas 29. The glue flap has a hinged opening tab 30. The middle adhesive area is defined by a closed cut score line 31 in the outer surface of the front panel. This closed cut score line extends only partially through the thickness of the paperboard and is located so that its lower portion is adhered to the opening tab while the upper portion adheres to a cover portion 32 of the glue flap, said cover portion being defined by a pair of inside-outside double cut score lines 33 which extend from the bottom edge of the glue flap upwardly and outwardly to the top front edge of the carton formed by fold line 28.

A top cover portion 34 is formed in the top panel 25 by a pair of inside-outside double cut score lines 35 which extend from the top front edge of the carton formed by fold line 28 rearwardly toward the back of the top panel.

Figure 2:
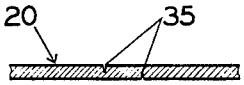
FIG. 2 is a cross-sectional view through the paperboard blank showing a score line of the inside-outside double cut type.

As shown in FIG. 2, the inside-outside double cut score lines are of the type which are offset from one another and extend only partially through the opposite surfaces of the paperboard whereby the opening feature is provided by severing the paperboard across the distance between double cut of the score line in a fashion well known in the art.

The double cut score lines 33 are spaced laterally outward of double cut score lines 35 at the fold line 28. A pair of short cut score lines 36 connect the ends of the outside cuts of double cut score lines 35 and 33 along fold line 28. The cut score lines 36 are formed in the outside surface of the paperboard blank shown in FIGS. 1 and 3 and extend only a portion of the way through the thickness of the paperboard. This construction provides a pair of arrow locking tabs 37 on the sides of the front cover portion 32 with the shoulders **37*a* of the tabs at the top edge of the glue flap 27.**

This construction allows the formation of the locking tabs without leaving a slit at the top front edge of the carton through which the locking tabs could otherwise accidentally be withdrawn. It also forms, upon opening, locking tabs of only a partial thickness of the paperboard. The invention thus provides a particularly reliable locking tab feature since the locking tabs must be bent to reclose and reopen the cover portion of the carton and yet the locking tabs are not so stiff as to make reclosing and reopening difficult.

Figure 7:
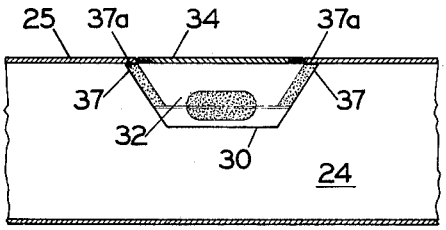
FIG. 7 is a fragmentary sectional view showing the locking feature from the inside of the reclosed carton.

The flaring of the cut score lines 33 provides a wedging action of the front cover portion 32 to progressively deflect the locking tabs as the front cover portion and locking tabs are pushed into the opening formed in the top panel by the top cover portion 34. The locking tabs are then allowed to straighten out and "lock" under the front edge of the top panel as depicted in FIG. 7 to provide the reclosed carton as shown in FIG. 6.

While the embodiment shown and described above is preferred, it should be understood that the score lines 35, which are shown as being of the inside-outside double cut score type, could also be of the intermittent perforated type or other suitable types. The inside-outside double cut score type shown, however, has the advantage that they form overlapping side edges on the top cover portion 34 which provides a somewhat neater reclosed appearance and helps maintain the top cover portion in substantially the same plane as the surrounding top panel of the carton when the cover is reclosed.

Figure 3:
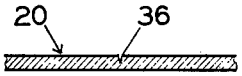
FIG. 3 is a cross-sectional view through the paperboard blank showing a score line of the single cut, partial thickness type.

The inside-outside double cut score lines 33 forming the front cover portion and locking tabs in the glue flap could also be of the intermittent perforated type or other suitable types with the cuts going all the way through the thickness of the paperboard. The cut score lines 36 which, as shown in FIG. 3, extend only a portion of the way through the thickness of the paperboard could also extend all of the way through. If they do extend all of the way through and score lines 35 are of the type that also do, then this embodiment would provide a pair of full thickness locking tabs, the formation of which would leave slits along the top front edge of the carton through which the locking tabs could be inserted and withdrawn.

It should be understood that this invention is not limited to the particular construction and arrangement of parts herein illustrated and described, but embodies all such modified forms as come within the scope of the following claims.

We claim:

1. A paperboard carton blank having an inside and an outside surface, said blank comprising:

a. hingedly connected bottom, top, front, back, and end panels, b. a front glue flap having a top edge and a bottom edge, said glue flap being hingedly connected along its top edge to the front of said top panel along a fold line and being adapted to be glued to the outside of said front panel, c. a first pair of laterally spaced cut score lines forming a front cover portion in said front glue flap and extending substantially from the bottom edge of said glue flap upwardly and outwardly to said fold line, d. a second pair of laterally spaced cut score lines forming a top cover portion in said top panel and extending substantially from said fold line rearwardly toward the back of said top panel, said second pair of cut score lines being spaced laterally inward of said first pair of cut score lines at said fold line, and e. a third pair of cut score lines formed in the outside surface of said blank along said fold line extending between the cut score lines of said first and second pairs of cut score lines to form a pair of arrow locking tabs on the sides of the front cover portion at the top edge of the glue flap, the arrow locking tabs of said front cover portion being adapted to be inserted inside of said front panel and under said top panel to lock said top cover portion closed when the carton formed from said carton blank is reclosed.

2. The paperboard carton blank as specified in claim 1 wherein said third pair of cut score lines is formed in the outside surface of the blank and extends only through a portion of the thickness of the blank.

3. The paperboard carton blank as specified in claim 1 wherein said first and second pairs of score lines are of the inside-outside double cut score type and said third pair of cut score lines is formed in the outside surface of the blank and extends between the outside cuts of said first and second pairs of said inside-outside double cut score lines and only through a portion of the thickness of the blank.

4. A paperboard carton having a reclosable opening feature and an inside and an outside surface, said carton comprising:

a. hingedly connected bottom, top, front, back, and end panels, b. a front glue flap having a top edge and a bottom edge, said glue flap being hingedly connected along its top edge to the front of said top panel along a fold line and glued to the outside of said front panel, c. a first pair of laterally spaced cut score lines forming a front cover portion in said front glue flap and extending substantially from the bottom edge of said glue flap upwardly and outwardly to said fold line.

d. a second pair of laterally spaced cut score lines forming a top cover portion in said top panel and extending substantially from said fold line rearwardly toward the back of said top panel, said second pair of cut score lines being spaced laterally inward of said first pair of double cut score lines at said fold line, and e. a third pair of cut score lines formed in the outside surface of said carton along said fold line and extending between the cut score lines of said first and second pairs of cut score lines to form a pair of arrow locking tabs on the sides of the front cover portion at the top edge of the glue flap, the arrow locking tabs of said front cover portion being adapted to be inserted inside of said front panel and under said top panel to lock said top cover portion closed when said carton is reclosed.

5. The paperboard carton as specified in claim 4 wherein said third pair of cut score lines is formed in the outside surface and extends only through a portion of the thickness of the paperboard blank.

6. The paperboard carton as specified in claim 5 wherein said first and second pairs of score lines are of the inside-outside double cut score type and said third pair of cut score lines is formed in the outside surface of the blank and extends between the outside cuts of said first and second pairs of said inside-outside double cut score lines and only through a portion of the thickness of the blank.

* * * * *